United States Patent [19]

McMurry et al.

[11] 4,110,057

[45] Aug. 29, 1978

[54] GAS LIFT MANDREL VALVE MECHANISM

[75] Inventors: Everett D. McMurry; Bolling A. Abercrombie, both of Houston, Tex.

[73] Assignee: McMurry Oil Tools, Inc., Houston, Tex.

[21] Appl. No.: 804,445

[22] Filed: Jun. 7, 1977

Related U.S. Application Data

[62] Division of Ser. No. 571,905, Apr. 28, 1975, Pat. No. 4,035,103.

[51] Int. Cl.[2] ..... F04F 1/18

[52] U.S. Cl. ..... 417/109; 137/155; 251/341

[58] Field of Search ..... 137/155; 417/109; 251/352, 341; 166/224 R

[56] References Cited

U.S. PATENT DOCUMENTS

| | | | |
|---|---|---|---|
| 2,804,830 | 9/1957 | Garrett | 417/115 |
| 2,808,781 | 10/1957 | Garrett | 417/109 X |
| 3,386,701 | 6/1968 | Potts | 251/352 X |

*Primary Examiner*—Alan Cohan
*Attorney, Agent, or Firm*—Arnold, White & Durkee

[57] ABSTRACT

A mandrel valve and gas lift valve mechanism that is adapted to be interconnected in a production tubing string within a well in order to produce fluid from the well under conventional gas lift methods. The gas lift valve includes a housing carried by a mandrel. The housing has a ball type valve element disposed in a valve chamber. Within the mandrel there is a linearly moving valve actuating sleeve having a cam which coacts with a stem on the ball valve so that linear movement of the sleeve causes rotation of the ball valve.

4 Claims, 8 Drawing Figures

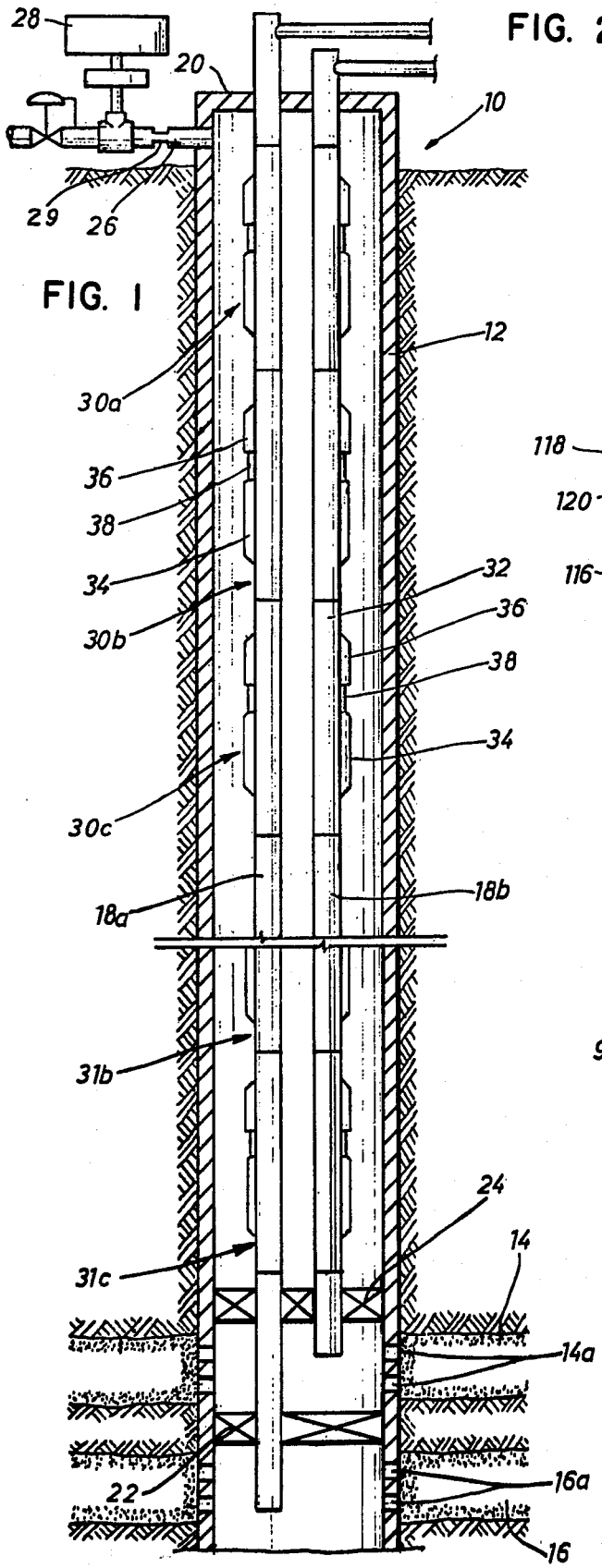
FIG. 1
FIG. 2
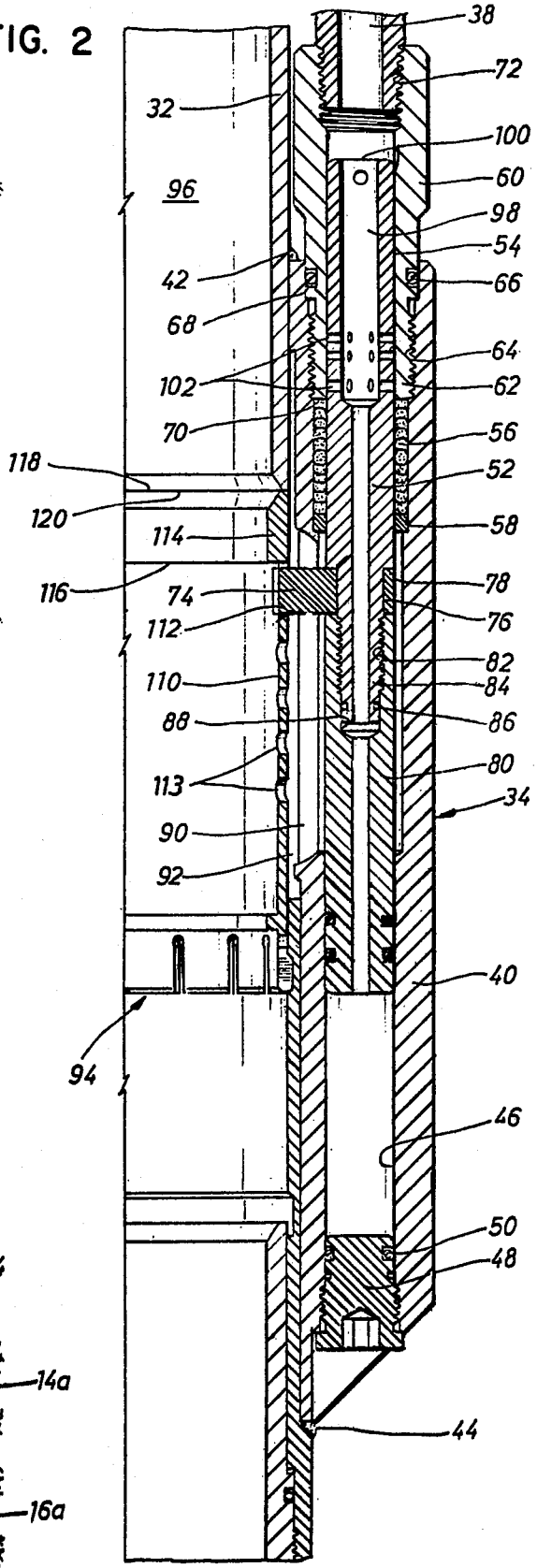

GAS LIFT MANDREL VALVE MECHANISM

This is a division of application, Ser. No. 571,905, filed Apr. 28, 1975 now U.S. Pat. No. 4,035,103 issued July 12, 1977.

FIELD OF THE INVENTION

This invention relates generally to gas lift systems for gas lift production of fluid from wells and more particularly relates to the combination of a gas lift valve and a flow controlling valve that may be referred to as a mandrel valve that is utilized in conjunction with conventional gas lift valve systems in order to render them selectively operable. Even more specifically, the invention relates to the provision of a plurality of flow controlling valves or mandrel valves that may be connected into the tubing string in dispersed arrangement or in groups at desirable levels within the well. Each of the plurality of mandrel valves may be selectively actuatable by means of a wire line device or other suitable well tool in order to selectively impart movement to control opened and closed positioning of the mandrel valves.

BACKGROUND OF THE INVENTION

In gas lift production operations, one or more tubing strings may be disposed within a well casing, each tubing string servicing a different producing zone. At various levels within the well, gas lift valves are located in each of the tubing strings and introduce gas into the tubing strings to provide a lifting function that lifts production fluid such as water and oil, from the producing zone to the surface of the earth where it may be carried away by appropriate piping. Gas lift valve mechanisms generally take the form of mandrels that are connected into and form a part of the tubing string and these mandrels are fairly short in length, being in the order of 3 to 6 feet.

The production life of gas lift valve mechanisms has been found to vary considerably because the well environment in which the gas lift valves are located may be of quite hostile nature. When a gas lift valve at any particular level within the well ceases to function properly, production of produced fluid may be severely reduced or perhaps terminated entirely. When a gas lift valve malfunctions, it is typically necessary to remove the tubing string from the well in order to replace or repair the defective gas lift valve and, at times, the tubing is pulled only after a number of gas lift valves within the well cease to function. Obviously, poor production can be expected if one or more of the gas lift valves have become defective.

Even though gas lift valves may continue to function normally, removal of tubing strings and replacement of gas lift valves is sometimes necessary due to changing well conditions. During the production life of a well, there may be a great change in the character of the fluid that is produced and at times it is necessary to provide gas lift valve mechanisms that are differently calibrated in order to satisfy the changing production requirements.

Where a well may be provided with two or more tubing strings for producing well fluid from two or more different production formations, introduction of gas into the annulus between the casing and the tubing strings must be discontinued in most cases in order to allow one of the tubing strings to be removed from the well for repair or replacement of gas lift valves. Even though the remaining tubing strings are in condition for efficient production, production must nevertheless be ceased for the total period of time necessary for servicing, thereby adding to the cost of servicing the value of losses in production.

Removing tubing strings from a well casing for repair or replacement is typically a very expensive, time consuming operation which involves utilization of costly equipment such as a well servicing rig plus its crew resulting in a very high cost per hour. For example, pulling the production tubing for servicing or recalibration may result in a servicing cost of $100,000 or more. Other factors that influence the cost of pulling tubing strings for repair concern equipment that is typically replaced when such well servicing operations are conducted. For example, packer devices must be broken loose between the casing and tubing and removed from the well and it is often necessary to replace such packer devices with new equipment when reinstalling the tubing within the well. It may also be necessary to remove more than one tubing string from the well even when servicing is required for a single tubing string of a multiple completion well. The magnitude of these servicing operations is, of course, undesirable both from the standpoint of the downtime or loss of production involved and because of the actual expense of the servicing operation.

It is considered desirable to provide wells that are produced by a gas lift operation with means for preventing the necessity for immediate pulling of a tubing string and conducting major servicing operations when it is determined that one or more gas lift valve mechanisms may have malfunctioned.

THE PRIOR ART

In order to provide for maintenance of production for extended periods of time, wells that are produced by a gas lift method have been provided with mandrel valve controlled gas lift valve mechanisms such as that set forth in U.S. Pat. No. 2,804,830 to Garrett et al. In the apparatus embodying the teachings of the invention, gas lift mandrels are connected into the tubing string in the usual manner and each of these mandrels are provided with a pair of gas lift valves that may be selectively operated by selective positioning of a slide valve that is linearly movable within the mandrel. The slide valve may be actuated by a suitable wire line system that is passed through the tubing.

One of the primary problems with gas lift valve mandrels that are presently available and that are provided with means for controlling opening and closing thereof is the fact that such mandrel valve mechanisms are of quite large dimension and therefore may be limited to single completion well systems for production of fluid from a single producing zone because of their size when it might be practical to utilize such gas lift valve systems in multiple completion wells. Another problem with slide valve controlled gas lift valve systems is the fact that seals for the slide valve mechanisms are continuously subjected to the well fluid being produced by the well. Where the well fluid is of corrosive or hostile nature and perhaps contains a large amount of sand or other foreign matter, the seals of the mandrel valves that control selection of the gas lift valves may be subjected to a high degree of deterioration during ordinary production operations. In case where O-ring type sealing elements are moved across ports for controlling the flow of a liquid or a gaseous medium there is always the possibility that the O-rings will be damaged during such movement. It would be desirable to locate the O-rings or other sealing elements out of the flow path of the gas or liquid so as to prevent damage thereto both during normal production operations and during actuating movement of the mandrel valve mechanism.

It is therefore a primary object of the present invention to provide a novel gas lift valve mandrel incorporating a selection valve or mandrel valve wherein the sealing element for the selection valve will not be subjected to damage during opening and closing movements of the mandrel valve mechanism.

It is a further feature of the present invention to provide a novel gas lift valve mandrel having a configuration and size that promotes utilization of multiple valves at different levels within a well even where more than one tubing string is utilized for well production.

It is a further feature of the present invention to provide a novel gas lift valve mandrel wherein multiple gas lift valves are utilized at various levels within the well in order to reduce the necessity of removing the tubing string from the well for replacement or repair of gas lift valves.

Another feature of the present invention contemplates the provision of novel gas lift valve mandrels that may be connected in series at various levels within the well either dispersed along the length of the tubing in groups of two or more gas lift valve mechanisms, and selected ones of the gas lift valve mechanism to be utilized for purposes of gas lift production while other selected ones of the gas lift valve mandrels may remain dormant for subsequent utilization as might become desirable.

It is also an important feature of the present invention to provide a novel gas lift valve mandrel whereby two or more gas lift valve mechanisms may be connected to the tubing string in groups at various levels within the well and whereby one or more of the gas lift valve mechanisms at each level within the well may be selectively opened or closed and utilized singly or collectively for gas lift production of the well.

It is also an important feature of the present invention to provide a novel gas lift valve mandrel wherein wear of the movable valve parts is maintained at a minimum during the production lift of the valve mechanism.

Another important feature of the present invention contemplates the provision of a gas lift valve mandrel having a mandrel valve that is provided with sealing element means that is not capable of being subjected to wear during normal opening and closing movement thereof.

It is an even further feature of the present invention to provide a novel gas lift valve mandrel incorporating a mandrel valve assembly wherein the mandrel valves may be selectively open or closed causing gas lift valves to be selectively active or dormant as desired without necessitating removal of the mandrel and gas lift valves from the tubing string.

Another important feature of the present invention concerns a novel gas lift valve mandrel that may be efficiently operated by conventional wire line tools or by other well tools such as pump down tools, etc.

Another important object of the present invention resides in the provision of a mandrel valve mechanism for use in conjunction with a gas lift valve, which mandrel valve mechanism utilizes a movable seal assembly and a stationary seal assembly for controlling the flow of gas from the gas lift valve into the production tubing of the well.

It is also a feature of the present invention to provide a novel mandrel valve mechanism for gas lift valve assemblies wherein the mandrel valve mechanism is pressure balanced at all times and the force necessary to impart movement to the mandrel valve mechanism is solely that necessary to accomplish the mechanical movement.

Other and further objects, advantages and features of the invention will become apparent to one skilled in the art upon consideration of this entire disclosure. The form of the invention, which will now be described in detail, illustrates the general principles of the invention but it is to be understood that this detailed description is not to be taken as limiting the scope of the present invention.

SUMMARY OF THE INVENTION

In accordance with the present invention the gas lift valve mechanism may conveniently take the form of a mandrel to which a single gas lift valve and mandrel valve mechanism is integrally assembled in order to provide for selective injection of a gaseous medium through the gas lift valve into the mandrel and thereby into the tubing string at the level of selected ones of the gas lift valve mechanisms, assuming that the mandrel valve element of the respective gas lift valve mechanism is in the opened position thereof. Two or more mandrels each carrying integral gas lift valve and mandrel valve mechanisms may be connected in end-to-end relationship in groups at each of several levels within the well bore with one or more of the gas lift valve mechanisms being disposed in the opened position thereof for conducting gas lift operations while others of the gas lift valve mechanisms are maintained in a closed or dormant condition and are available for future utilization in the event one or more of the active valves must be closed for any particular reason.

Each of the mandrels may be provided with a mandrel valve mechanism having the seals of the mandrel valve mechanism disposed out of continuous flowing contact with the flow stream of the production fluid produced through the tubing string. The mandrel valve mechanism may be actuated by means of a sleeve that is linearly movable within the mandrel and is in turn actuated linearly by a conventional wire line tool, pump down tool, or any other suitable downhole well tool. The linearly movable sleeve is provided with a mechanical interconnection with the mandrel valve, causing actuation of the mandrel valve between its open and closed positions responsive to selective linear actuation of the valve actuating sleeve. The mandrel valve of each of the mandrels may be selectively opened or closed as is desirable to achieve optimum gas lift production operations or as desired to exclude defective gas lift valve mechanisms from well operations, thereby defering the necessity for immediate pulling of the tubing string for repair or replacement of defective gas lift valves.

The mandrel valve elements for each of the gas lift valve mandrels may be of linearly movable type or rotary type, as desired, but in each case, the sealing elements of the valve mechanism will be disposed away from the flow path of the flowing well fluid within the production tubing and will not be subjected to deterioration or damage by foreign matter such as sand, scale, etc. Moreover, during movement of the mandrel valve mechanisms between the open and closed positions thereof the seals will not pass large flow ports and there will be little tendency for the seals to become cut or worn during opening and closing movement.

Two sealing elements or packings are utilized in the structure of the mandrel valve one of which is stationary within the housing structure with the valve element passing therethrough with the other seal or packing being carried by the valve element and being movable with respect to the housing structure. The packings are of substantially the same dimension and cooperate to maintain the mandrel valve element in a balanced condition at all times thereby requiring that the force necessary for movement of the mandrel valve be sufficient only for movement of the mechanical structure of the valve element. It is not necessary to overcome a pressure induced force in order to achieve opening or closing of the mandrel valve mechanism.

BRIEF DESCRIPTION OF THE DRAWINGS

So that the manner in which the above recited features, advantages and objects of the present invention as well as others which will become apparent are attained and can be understood in detail, more particular description of the invention, briefly summarized above, may be had by reference to the embodiments thereof which are illustrated in the appended drawings, which drawings form a part of this specification.

In the Drawings

The present invention both as to its organization and manner of operation may best be understood by way of illustration and example of certain preferred embodiments when taken in conjunction with accompanying drawings in which:

FIG. 1 is a diagrammatic illustration of a well of the dual completion type having two tubing strings and illustrating provision of gas lift valve mechanisms constructed in accordance with the present invention and being shown to be assembled in groups at a plurality of levels within the well.

FIG. 2 is a half sectional view of a portion of a gas lift valve mandrel, illustrating a mandrel valve that is constructed in accordance with the present invention, with the valve being shown in its closed position.

Figure 3:
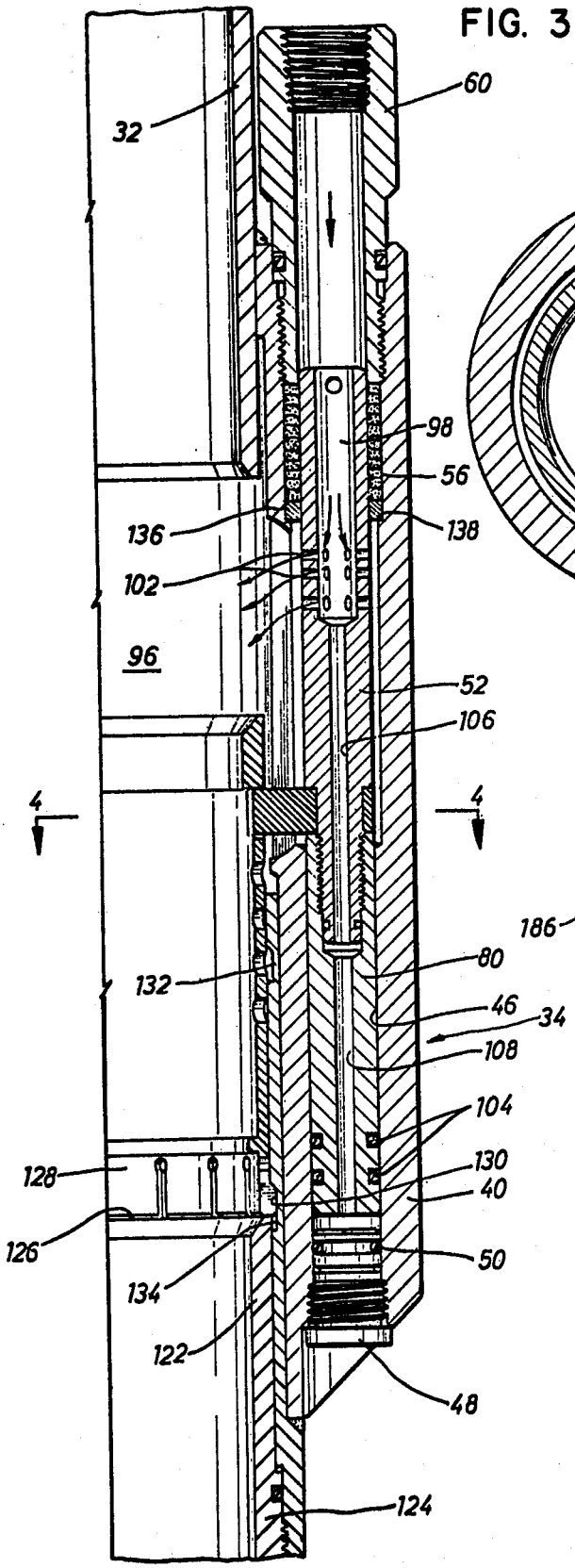

FIG. 3 is a sectional view similar to that illustrated in FIG. 2 with the mandrel valve mechanism being illustrated in its open position.

Figure 4:
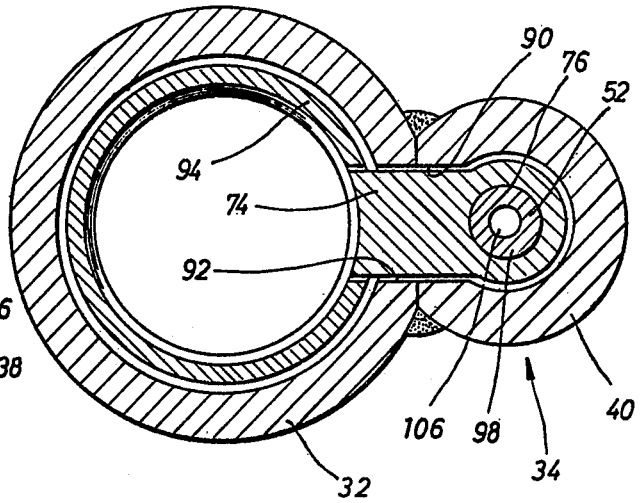

FIG. 4 is a sectional view taken along line 4—4 of FIG. 3.

Figure 5:
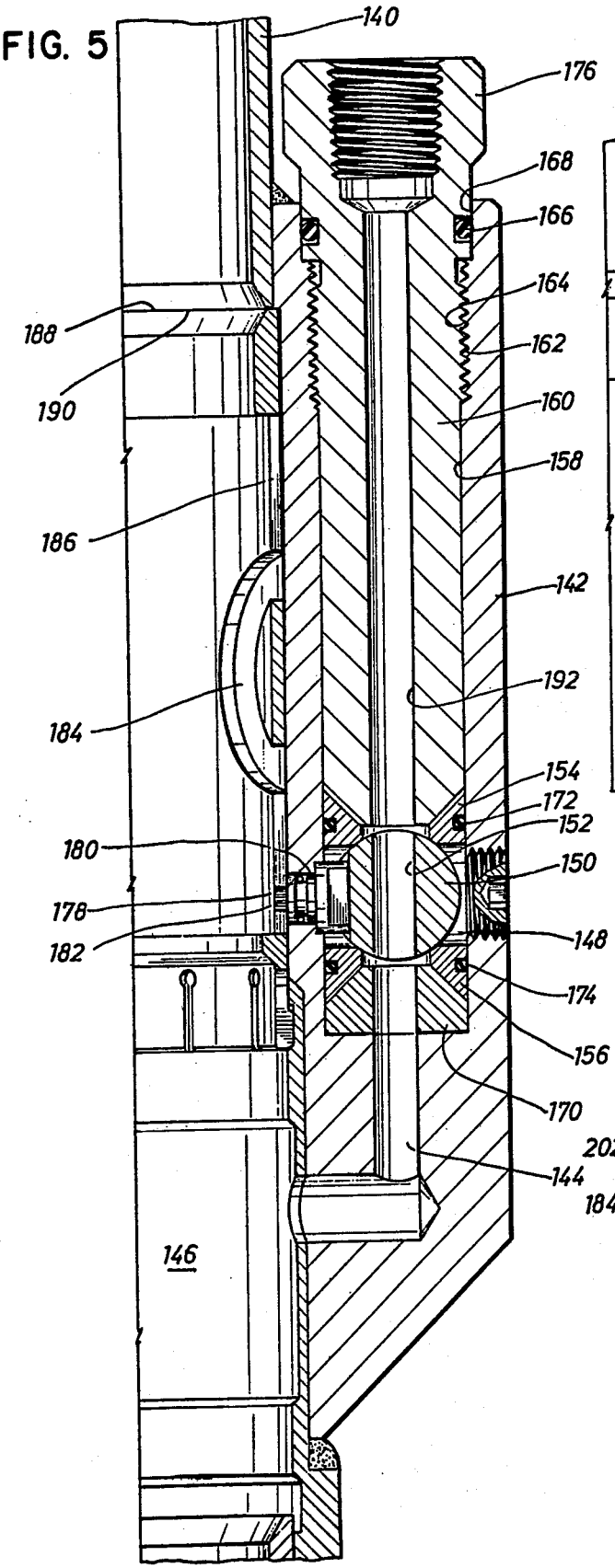

FIG. 5 is a half sectional view of a portion of a gas lift valve mandrel illustrating a mandrel valve mechanism that constitutes a modified embodiment of the present invention, employing a ball valve for controlling flow and showing the ball valve being disposed in its open position.

Figure 6:
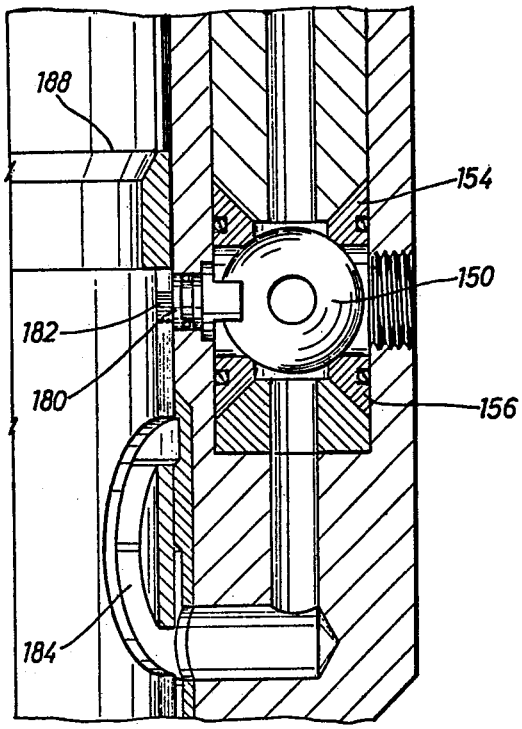

FIG. 6 is a fragmentary sectional view of the mandrel valve mechanism of FIG. 5 illustrating the ball valve and its valve control mechanism in the closed position thereof.

Figure 7:
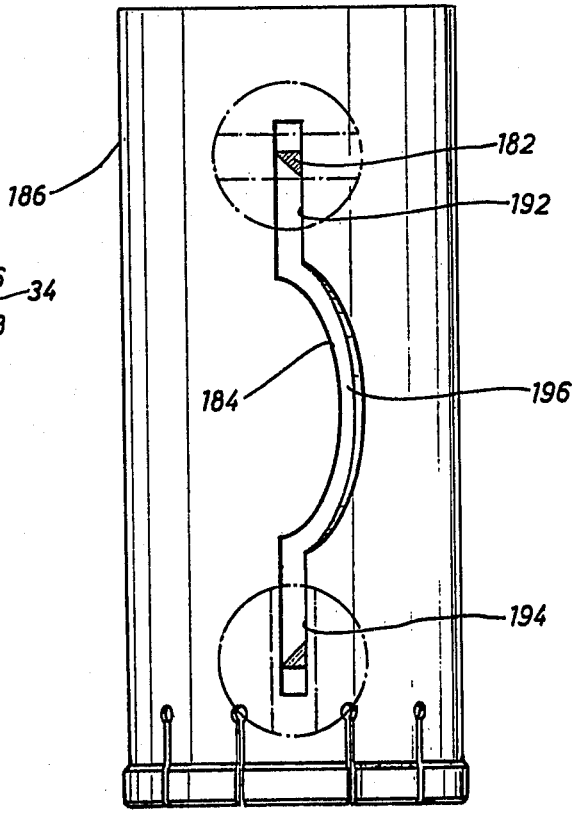

FIG. 7 is an elevational view of the valve controlling sleeve of the valve machanism illustrated in FIG. 5, illustrating the actuating cam track thereof and showing in broken line the relative position of the valve ball as the actuating sleeve is moved linearly within the mandrel.

Figure 8:
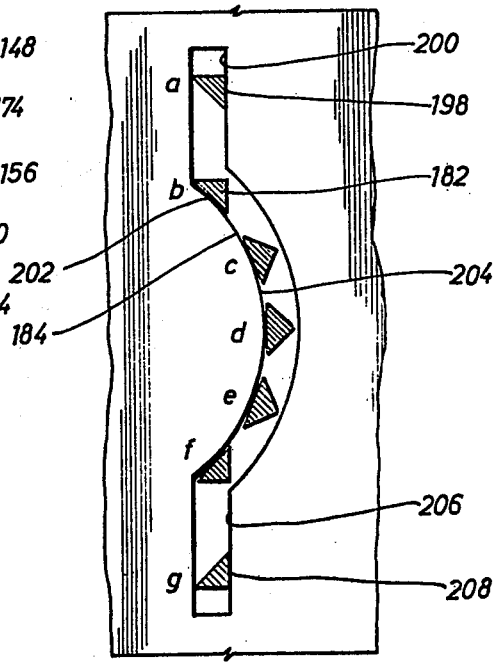

FIG. 8 is a diagrammatic illustration of the relationship between the valve ball cam track and the cam follower type valve actuating element as the sleeve is moved to various positions during opening and closing movement of the valve.

DESCRIPTION OF PREFERRED EMBODIMENTS

Referring now to the drawings and first to FIG. 1, there is depicted a well, indicated generally at 10, having a well casing 12 that extends downwardly through the earth to producing formations 14 and 16 with apertures **14*a* and 16*a* formed in the well casing at the respective production formations in order to allow communication of production fluid from the respective formations into the well casing. Extending downwardly into the well bore are a pair of production tubing strings 18*a* and 18*b* that are typically supported by a well head 20 disposed at the upper extremity of the casing 12. The tubing strings 18*a* and 18*b* extend to the level of respective ones of the production formations 14 and 16 and are sealed with respect to the casing. In the case of tubing string 18*a*, and with respect to both the casing and tubing string 18*a*, in the case of tubing string 18*b*, by means of packing devices 22 and 24, respectively. Production formation 14 introduces production fluid into the casing between the packing devices 22 and 24 and this production fluid is caused to enter the tubing string 18*b*. Likewise, production formation 16 introduces production fluid into the casing below the packer 22 thereby causing fluid produced from this formation to be introduced into the tubing string 18*a***.

In order to produce fluid by gas lift operations a gas supply conduit 26 is communicated to the annulus between the casing and the tubing strings above the upper packer 24 under the influence of a gas supply controller 28 that controls injection of pressurized gas into the annulus from a suitable gas supply system through a choke 29.

As illustrated in FIG. 1, each of the tubing strings may be provided with a plurality of gas lift valve and mandrel valve mechanisms that are interconnected into the respective tubing strings and may be either provided in several groups positioned appropriately in spaced relation within the well or provided in any other suitably spaced relation within the tubing. One group of three gas lift valve mechanisms is illustrated at **30*a*, 30*b* and 30*c*, being interconnected with tubing string 18*a*. Another group of gas lift valve and mandrel valve mechanisms connected into tubing string 18*a* is partially illustrated generally at 31*b* and 31*c* at the lower portion of FIG. 1. The opposite tubing string 18*b*** may also have a number of groups of gas lift and mandrel valve mechanisms that are disposed in spaced relation along the length of the tubing string. The particular grouping of gas lift valves illustrated in the drawings is not intended to limit the invention in any way it being obvious that other gas lift valve arrangements are also within the spirit and scope of the invention.

Ordinarily only one of the various gas lift valve mechanisms, which may also be referred to as mandrels or mandrel assemblies, may be disposed in condition for introducing gas from the well annulus into the respective tubing string, while the remaining mandrel assemblies of each group of mandrel assemblies may be disposed in a closed position thereof in readiness for future use. In the event an active mandrel assembly should malfunction for any reason, the tubing string in which that valve is located may be placed back into efficient service simply by closing off the defective mandrel assembly and by opening one of the other mandrel assemblies of that particular group. There will be no necessity for pulling of the tubing string for replacement of a mandrel assembly until each of the mandrel assemblies of one particular group have become unservicable.

Under circumstances where it may become desirable to modify production operations by changing the character of gas introduction into the production tubing of the well selected ones of the gas lift valve mandrels may be rendered active or inactive simply by opening or closing selected ones of the mandrel valves as desired. Additionally, gas lift valves of differing calibration or having differing operating pressure may be initially connected into the tubing string and gas lift production operations may be changed as desired by rendering active those gas lift valves having desired calibration at various levels within the respective tubing string while closing the mandrel valves of the other ones of the gas lift valves so as to cause the other valves to remain dormant.

Each of the mandrel assemblies, as shown in FIG. 1 may comprise a tubular mandrel housing 32 having threaded connections at the upper and lower extremities thereof for connection either to conventional tubing or to another mandrel housing. A mandrel valve 34 may be connected to the mandrel housing 32 and may be disposed in fluid communication with the interior of the tubular housing. A gas lift valve 36 may also be retained by the mandrel housing and may serve to introduce gas from the annulus into the mandrel housing under control of a check valve mechanism 38. The gas lift valve assembly 36 and the check valve mechanism 38 may be of the type manufactured by McMurry Oil Tools, Inc. and in the alternative may take any other suitable form as is desirable.

In accordance with the present invention it will be desirable to provide each of the valve mechanisms with a mandrel valve device having the capability of rendering the respective gas lift valve mechanism active or inactive. In accordance with the present invention a mandrel valve may conveniently take the form illustrated generally at 34 in FIG. 2 where a valve housing 40 is shown to be connected by welding or by any other suitable means of connection to the tubular mandrel housing 32, upper and lower welds being shown at 42 and 44, respectively. The valve housing 40 may be formed to define an enlongated valve passage defined in part by a bore 46 that may be closed at one extremity thereof by means of an internal closure plug 48 that is threadedly received by the housing 40 and carries an annular sealing element 50 that maintains a fluid tight seal between the plug element 48 and the bore 46.

An elongated valve element 52 may be movably disposed within the elongated passage and may be provided with an outer generally cylindrical portion 54 that is maintained in sealed engagement with respect to the internal wall structure of the housing 40 by means of an annular packing 56 that is retained within the packing chamber 58 defined by an enlarged portion of the passage through the valve housing. A retainer and connector element 60 may be received in close fitting engagement about one extremity of the elongated valve element 52 and may be provided with an externally threaded portion 62 that is received by an internally threaded portion 64 of the housing structure. An annular O-ring type sealing element 66 may be retained within an appropriate groove formed in the connector and retainer element 60 and may engage an internally generally cylindrical wall portion 68 defined on the housing 40 in order to provide sealing engagement between the element 60 and the housing. An annular shoulder 70 defined at one extremity of the connector and retainer element 60 may be disposed in engagement with one extremity of the packing element 56, thereby serving to retain the packing element within the packing chamber 58. The opposite extremity of the connector and retainer element 60 may be provided with internal threads 72 or any other suitable means of connection that may receive one extremity of the check valve mechanism 38 illustrated in FIG. 1.

It will be desirable to provide means for inducing linear movement to the elongated valve element 52 within the passage of the valve housing 40 and, in accordance with the present invention, such means may conveniently take the form of a valve actuator element 74 that may be disposed about a generally cylindrical portion 76 of the valve element and may be retained in engagement with an annular shoulder 78 by means of a retainer portion 80 that may be provided with internal threads 82 for threaded engagement with an externally threaded portion 84 formed adjacent one extremity of the valve element. An annular sealing element, such as an O-ring or the like 86, may be retained within an annular groove defined in the valve element 52, causing the sealing element to be disposed in engagement with an internal cylindrical surface 88 defined within the retainer portion. The valve housing 40 may be formed to define an elongated opening 90 that may be disposed in registry with an elongated opening 92 formed in the mandrel housing 32. A portion of the valve actuating element 74 will extend through the registering openings 90 and 92 for engagement with a valve actuating sleeve 94 that is movably disposed within the tubular mandrel housing 32 and which is movable linearly within the tubular mandrel housing by means of a wire line tool or any other suitable downhole tool in the manner discussed hereinbelow.

It will be desirable to provide means for allowing the flow of gas from the check valve structure 38 through the elongated valve element 52 and into the tubular passage 96 of the mandrel housing 32 in the open position of the valve element. In accordance with the present invention such means may conveniently take the form illustrated in FIG. 2 where the valve element 52 may be provided with an internal flow passage 98 having an inlet opening 100 defined at one extremity of the valve element 52 and which passage is intersected by a plurality of transverse passages 102 that are formed in the wall structure of the valve element. In the closed position of the valve element, the transverse passages 102 will be disposed on the upstream side of the annular packing element 56, thereby causing the packing element to block the flow of the gaseous medium through its sealed engagement with the outer periphery of the valve element. Following linear movement of the valve element to the open position thereof as shown in FIG. 3, flowing gas from the passage 98 will be allowed to flow through the passages 102 into the production passage defined in the mandrel housing 32, bypassing the annular packing element 56.

In order to provide a guiding and balancing function to maintain the stability of the elongated valve element as it moves linearly within the passage defined within the valve housing 40, the retainer portion 80 of the valve element may be of elongated generally cylindrical configuration and may be received within the cylindrical bore 46. A pair of annular sealing elements 104 which may be of the O-ring type may be retained within annular grooves formed in the retainer portion 80, causing the O-ring sealing elements to maintain sealed engagement between the retainer portion and the cylindrical bore 46 as the retainer portion is moved linearly within the cylindrical bore 46. Bores 106 and 108 are formed in the valve element 52 and the retainer portion 80 which bores serve to communicate the flow passage 98 with that portion of the bore 46 disposed at the opposite extremity of the valve element, the bores 106 and 108 allowing displacement of fluid to compensate for volume change as th valve element is moved, thereby preventing pressure or vacuum interference with valve movement.

It is desirable that the mandrel valve element 52 be pressure balanced in order to insure that the force that is required to impart movement to the valve element is only of sufficient magnitude for accomplishing the desired mechanical movement. The pressure of the gaseous medium controlled by the mandrel valve does not add to or detract from the force required for accomplishing valve movement. To accomplish this feature, the internal diameter of the stationary packing is substantially the same dimension as the internal diameter of the bore 46 and therefore, pressure acts equally at both extremities of the elongated valve element to develop equal forces acting upon the valve element regardless of whether the valve element is disposed in the open or closed position thereof. The bores or passages 106 and 108 communicate to assist in achieving the pressure balanced condition of the valve element by communicating pressurized medium from the inlet opening 100 of the valve element to that portion of the valve chamber disposed below the valve element as shown in FIG. 2.

It should also be noted that the packing 56 is stationary with respect to the housing structure of the mandrel valve while the cooperating O-rings 104 define a movable seal that reciprocates within the valve chamber upon movement of the mandrel valve element. The movable seal, being defined by the cooperating O-rings, is of very low friction characteristics and the break out force of this seal is quite low. The friction characteristics of the stationary seal 56 are slightly higher than the movable seal and the break out force required for initial movement of the valve element is also nominally higher than the O-ring seal. The two spaced seals, however, cooperate to develop exceptional sealing capability and additionally function as a low friction seal between the valve housing and the valve element with a rather low break out force requirement. For example, a force of approximately 100 pounds will induce movement to the valve element of the present invention, while other mandrel valve mechanisms on the market may require a force as high as 400 pounds to break the seals and induce movement of the valve element from the closed to the open positions thereof.

In order to provide for linear movement of the valve element, a valve actuating sleeve 94 may be disposed within the flow passage 96 of the tubular mandrel housing 32 with a generally cylindrical body portion 110 thereof having an aperture 112 within which is received the projecting valve drive portion of valve actuator element 74. Ports 113 may be formed in the sleeve 94 to allow sufficient flow of fluid behind the sleeve to prevent any undesirable build up of sand or other foreign matter. The upper portion of the sleeve 94 may be defined by an annular rather thick portion 114 defining an annular shoulder 116 that may be engaged by a typical wire line tool, such as the wire line tool manufactured by Otis Engineering Company and illustrated on page 4122 of the 1974–75 Composite Catalog printed by the Gulf Publishing Company of Houston, Texas. Although wire line tools will function quite efficiently for imparting controlling linear movement to the sleeve 94 either upwardly or downwardly within the passage 96 as desired, other types of well tools such as pump down well tools may be efficiently employed without departing from the spirit and scope of the present invention.

At the upper extremity of the annular portion 114 of the valve actuating sleeve an annular abutment surface 118 is formed that is adapted for engagement with an annular stop surface 120 to define the upper limits of travel of the valve actuating sleeve and thus the valve element. A lower stop for limiting downward movement of the sleeve may be defined by the internally projecting portion 122 of a connector element 124 that is disposed in threaded engagement with the lower portion of the mandrel housing structure 32. The connector element 124 may be provided with threads at the lower extremity thereof in order to facilitate connection of the mandrel assembly to conventional well production tubing or to the upper extremity of another such mandrel assembly. The upper extremity of the projecting portion 122 may define an annular stop surface 126 that is engaged by the lower extremity of the valve actuating sleeve as the valve actuating sleeve moves to the opened position. Retention of the valve actuating sleeve in the opened or closed positions thereof may be accomplished by means of an annular collet portion 128 that defines yieldable shoulder portions 130. The shoulder portions 130 of each of the collet segments may enter annular internal grooves 132 and 134 respectively to establish retaining engagement with the internal wall structure of the tubular mandrel housing. As the valve actuating sleeve moves upwardly to the closed position thereof the locking detents defined by the various collet segments will spring outwardly into received engagement within the annular retention groove 132. The valve actuating sleeve and thus the valve element will therefore be retained in open condition thereof and will not have any tendency for inadvertent movement toward the closed position of the valve. Likewise, in the open position of the valve element and valve actuating sleeve, the plurality of detent elements defined by the collet portion 128 of the valve actuating sleeve will spring outwardly into received engagement within the annular groove 134, thereby positively securing the sleeve and thus the valve element in the open positions thereof.

The annular packing 56 that is disposed about the valve element 52 may include one or more packing retainer rings such as shown at 136 in FIG. 3 that engage internal shoulder means 138 defined within the valve housing structure 40, the annular retaining element 136 being defined by a suitable relatively rigid material such as metal or any suitable form of rigid plastic material. One side of the retainer ring 136 may be formed in a generally V-shape in order to conform to the shape of Chevron packing elements that interfit to define the elongated cylindrical packing 56.

Where presently available sliding sleeve type mandrel valves are employed in gas lift operations for controlling the active or dormant nature of the various gas lift valves, it is obvious that the packing or sealing element of the valve structure must be essentially the size of the internal dimension of the tubing or larger. The section modulus of the packing material of more conventional mandrel valve mechanisms, therefore, is substantially greater than the section modulus of the packing of the valve structure of the present invention. Because the mandrel valve mechanism of the present invention is disposed outwardly of the tubing string rather than internally thereof, the physical size of the valve mechanism and thus the physical size of the packing required for controlling the sealing ability of the valve can be designed as small as is necessary to allow optimum flow of gas through the gas lift valve mechanism with which it is associated. This feature materially affects the nature of force that is required for movement of the valve mechanism when controlling forces are applied through the use of wire line tools or other such tool devices. Positioning of the mandrel valve mechanism outwardly of the tubing string rather than inwardly thereof facilitates effective limiting of the overall size of the gas lift mandrels and effectively provides for utilization of gas lift mandrels in multiple completion systems rather than limiting use to a single completion wells where the well is produced from a single production zone.

Service life of the valve mechanism is further enhanced by the fact that the annular packing element 56 is of stationary nature. Gas flow through the valve mechanism begins upon the lowermost ones of the ports 102 clearing the lower portion of the annular packing retainer element 136 and therefore there is little condition under which a flow across the packing element will constitute a condition of wear. Likewise, the annular sealing elements 104 carried by the retainer portion 80 of the valve element do not cross any ports whatever during movement of the valve element between the opened and closed position thereof. There is therefore no significant tendency for the O-ring type sealing elements 104 to be subjected to severe wear as opening and closing movements occur. An even further feature that increases the service life of the present invention is the fact that the packing element 56 and the O-ring type sealing elements 104 are not in any way subjected to flow induced deterioration by the flowing production fluid as production operations are conducted.

A modified form of the invention is illustrated in FIGS. 5–8 wherein a ball valve is utilized for opening and closing of the valve flow passage upon reciprocation of a valve actuating sleeve. To a tubular mandrel housing 140 may be connected a valve housing 142 having a gas admission passage 144 defined therein and communicating with a production flow passage 146 formed within the tubular housing of the mandrel. The valve housing 142 may also be formed to define a valve chamber 148 within which may be rotatably disposed a valve ball 150 having a flow passage 152 formed therein and disposed for registry with the passage 144 of the housing. Annular seat elements 154 and 156 may be disposed within the valve chamber 148 and may engage the valve ball in order to provide appropriate seating capability. The valve chamber may be defined at least in part by an elongated bore 158 defined in the housing structure and a connector and retainer element 160 may be provided with an externally threaded portion 162 that is received by internal threads 164 defined adjacent the upper extremity of the bore 158. An annular sealing element 166 may be retained within an appropriate groove formed within the connector and retainer portion 160 which sealing element may engage a cylindrical surface 168, providing an appropriate seal between the connector and retainer element and the valve housing. A positioning element 170 may also be received within the bore 158 and may serve to engage and position one of the seat elements 156 so as to establish proper seating engagement with the valve ball 150. Annular seals 172 and 174 may be carried by each of the seat elements 154 and 156, respectively, in order to provide proper sealing engagement between the seat elements and the internal bore 158. The connector and retainer portion 160 may be provided with an internally threaded outer extremity 176 to which may be connected a check valve mechanism that separates the mandrel valve from the gas lift valve of the gas lift mandrel system.

The valve housing 142 may be provided with an internal stem opening 178 through which may extend a valve stem 180 that is disposed in driving engagement with the valve ball 150. A cam follower element 182 may be formed at the outer extremity of the valve actuating stem and may have a cooperative functioning relationship with a cam track 184 that may be defined within a valve actuating sleeve 186 that is moved linearly in the same manner as discussed above in connection with valve actuating sleeve 94 in conjunction with FIGS. 1–4.

As shown in FIG. 5, the valve actuating sleeve 186 is in its uppermost position with its upper abutment surface 188 disposed in abutting relationship with an annular stop surface 190 defined by the tubular mandrel housing 140. In this position, the valve ball is maintained in its opened condition with the passage 152 thereof disposed in registry with passage 144 of the housing and the passage 192 that extends through the connector and retainer element 160. In this condition, pressurized gas is introduced through the mandrel valve mechanism into the production passage 146 of the tubing string and gas lift operations are conducted.

As illustrated in FIG. 6, the same structure is illustrated as in FIG. 5, but the valve actuating sleeve 186 is shown to have been moved downwardly by wire line or downhole tool devices, causing the cam track 184 to move relative to the cam follower 182 such that rotary movement is imparted to the valve stem 180 and through connection with the valve ball, imparts rotary movement to the valve ball, moving it to the closed position thereof.

As illustrated in FIG. 7, the valve actuating sleeve 186 will be formed to define a cam track 184 of the configuration having generally vertically oriented upper and lower portions 192 and 194 with an intermediate curved portion 196 disposed therebetween. The cam follower, as shown in FIG. 7 will have a generally triangular configuration that will react against the curved portion of the track in such manner as to cause substantially 90° rotation of the cam follower and thus the valve ball as the curved portion of the cam track is traversed. The elongated substantially linear end portions of the cam track serve to lock the cam follower either in the open or closed position thereof, thereby serving to retain the ball valve element either open or closed without allowing inadvertent movement thereof to the opposite position. As shown in broken line in FIG. 7, with the valve actuating sleeve moved downwardly, the valve element will be closed while upward movement of the valve actuating sleeve will impart opening movement to the valve element. This is opposite to the opening movement that will be necessary to impart movement to the mandrel valve structure identified in FIGS. 1 and 2.

With reference now to FIG. 8, there is shown a diagrammatic illustration of the cooperative relationship between the curved portion of the cam track and the cam follower 182 that causes substantially 90° rotation of the valve ball between its open and closed position. With the valve actuating sleeve and follower in the positions illustrated at *a*, the valve element will be maintained in its closed condition by virtue of engagement between the surface 198 of the cam follower and surface 200 of the cam track. As the valve actuating sleeve is moved upwardly to position *b*, surface 202 of the cam follower now engages surface 204 of the cam track and initiates rotary movement to the cam follower and thus to the valve element. As movement continues through positions *c* and *d*, the sleeve will have moved sufficiently to cause substantially 45° rotation of the valve element. Continued rotary movement of the cam follower will occur through positions *e* and *f* and upon reaching position *f* the cam follower will have rotated substantially 90°, causing rotation of the valve element to its open position such as shown in FIG. 7. Continued movement of the sleeve upwardly to position *g* will again cause locking of the cam follower in the position shown by means of engagement between surfaces 206 and 208 of the cam track and cam follower respectively.

Although the cam follower is illustrated as being of generally triangular configuration and the cam track has a particular configuration, it is not in any way intended to limit the present invention specifically to cam tracks and followers of such configuration, it being obvious that other cam tracks and followers as well as other structural devices may be utilized within the spirit and scope of the present invention to accomplish 90° rotation of a valve element between its opened and closed positions responsive to linear movement of a valve actuating sleeve by means of a wire line tool or any other suitable downhole tool device.

OPERATION

Assuming that one or more tubing strings are provided in a well casing to establish communication with one or more production formations, a gas lift valve system for achieving gas induced production of the various well formations will include a plurality of mandrels connected in series groups at several different locations in the tubing string, i.e., at several different levels within the well. Assuming that a single gas lift valve at each of the various levels is sufficient to maintain optimum production, and further assuming that each of the various groups of gas lift mandrel mechanisms comprises three valves connected in series, two of the valves will be maintained in the closed condition thereof while the third valve would be maintained in its open or active position gas being controllably introduced through the valve mechanism into the production tubing. Assuming then that the active valve at any one of the several levels becomes defective such as by wear, corrosion or any one of a number of other factors, it is not necessary to pull the tubing strings from the well in order to replace or repair that particular valve. An appropriate wire line tool will simply be run into the tubing string involved, perhaps while production is allowed to continue in the other tubing strings of the well if the well is a multiple completion. By utilizing the wire line actuated tool, pump down tool or any other suitable downhole tool mechanism, it is simply necessary to engage the valve actuating sleeve of the appropriate active, but defective valve and move it to its closed position, ceasing gas lift operations through that particular valve. The wire line tool then may be manipulated in such manner as to engage the valve actuating sleeve of another one of the dormant valves of that particular gas lift valve group, moving it to the open condition thereof and starting production operations through the newly opened gas lift valve. In this way, production can be continued with very little down time and at very low cost even when servicing operations are conducted to insure the provision of efficient gas lift valve mechanisms at each of the several valve levels.

Where changing well conditions occur, it may be appropriate to open more than one mandrel valve mechanism at each of the various levels within the well or at least at more than one particular level within the well. This can be simply accomplished by manipulating the various valve actuating sleeves of the gas lift valve mandrel mechanisms to achieve opening of selected ones of the mandrel valves and thereby render the associated gas lift valve active. It is therefore apparent that the gas lift valve may be controlled in any operational sequence that may be desired, either causing opening of one valve, more than one valve or all of the valves at any particular level. Likewise all of the valves at any particular level may be selectively closed if desired to achieve optimum production operations.

It is also obvious that the valve mechanisms of the present invention will function quite efficiently even under conditions where gas flow might be reversed with gas being introduced into the tubing strings and with production occurring in the annulus of the well.

From the foregoing it is readily seen that the present invention is one well adapted to attain all of the objects and advantages hereinabove set forth, together with other advantages that are obvious and inherent to the structure of the invention.

It will be understood that certain features and subcombinations are of utility and may be employed without reference to other features and subcombinations. This is contemplated by and is within the spirit and scope of the present invention.

As many possible embodiments may be made of the present invention without departing from the spirit or scope thereof, it is to be understood that all matters herein set forth or shown in the accompanying drawings are to be interpreted as illustrative and not in any limiting sense.

The invention having been described, what is claimed is:

1. A mandrel valve mechanism for controlling the flow of gas through the gas lift valve mechanism that achieves gas induced production of fluid from wells, said mandrel valve mechanism comprising:

a tubular mandrel having a production passage therethrough adapted to be interconnected between sections of production tubing, said tubular mandrel being formed to define opening means intermediate the extremities thereof;

a valve housing being carried by said mandrel, said valve housing defining an internal valve chamber having an inlet opening and having an outlet opening disposed in registry with said opening means of said tubular mandrel, said valve housing being formed to define a valve stem passage communicating said valve chamber with said production passage of said tubular mandrel;

a valve element being disposed within said valve chamber and being movable from a closed position where said valve element blocks communication between said inlet and said outlet to an open position where communication between said inlet and outlet is defined through said valve element;

said valve element comprises a ball type valve element being disposed within said valve chamber and being rotatably movable for controlling flow through said valve mechanism and valve stem means being disposed in operative engagement with said ball type valve element and extending from said valve chamber through said valve stem passage and into said tubular mandrel, said valve stem means having cam follower means formed thereon; and valve actuating means being movably disposed within said mandrel and having mechanical interconnection with said valve element, said valve actuating means having cam means formed thereon with said cam means being disposed in receiving relation with said cam follower means, upon linear movement of said valve actuator means within said tubular mandrel said cam follower means being induced by said cam means to cause substantially 90° rotation of said valve stem means, thus causing substantially 90° rotation of said ball type valve element within said valve chamber said valve actuating means being controllably movable responsive to manipulation thereof by a valve actuating tool that is movable within said production tubing of said well.

2. A mandrel valve mechanism as recited in claim 1, wherein:

said valve actuating means is in the form of sleeve means that is linearly movable within said production flow passage of said tubular mandrel and is subject to linear actuation by tool means that is passed through the production tubing of the well; and said cam means is in the form of a groove defined in said valve actuation sleeve means, said groove receiving said cam follower means and cooperating with said cam follower means to induce said rotation to said cam follower means and said valve actuation stem responsive to linear movement of said valve actuating means within said production flow passage.

3. A mandrel valve mechanism as recited in claim 2, wherein:

said groove defining said cam means is of arcuate intermediate configuration with substantially straight portions formed on either side of said arcuate intermediate portion, said arcuate intermediate portion serving to induce rotation to said cam follower means and said straight portions functioning to lock said cam follower means against inadvertent rotary movement.

4. A mandrel valve mechanism as recited in claim 2, wherein:

said cam means includes a rotation inducing portion that cooperates with said cam follower means to cause rotation of said cam follower means and locking portions that cause locking of said cam follower means to prevent inadvertent rotation thereof in both the open and closed positions of said valve actuating means.

* * * * *

UNITED STATES PATENT OFFICE

CERTIFICATE OF CORRECTION

Patent No. 4,110,057 Dated August 29, 1978

Inventor(s) Everett D. McMurry; Bolling A. Abercrombie

It is certified that error appears in the above-identified patent and that said Letters Patent are hereby corrected as shown below:

Column 9, line 13, delete "th" and insert --the--.
Column 13, line 56, before "gas" insert --with--.
Column 16, line 12, delete "actuation" and insert --actuating--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*